US007103945B2

(12) United States Patent
Amos et al.

(10) Patent No.: US 7,103,945 B2
(45) Date of Patent: Sep. 12, 2006

(54) MACHINE FOR JOINING YARNS

(75) Inventors: Cathy Amos, Rocky Face, GA (US); Bernard Bird, Red Bank, TN (US); Philippe Massotte, Gueberschwihr (FR); Hubert Liebmann, Wittenheim (FR)

(73) Assignees: Williams Specialty, Dalton, GA (US); Superba S.A.S., Mulhause (FR)

( * ) Notice: Subject to any disclaimer, the term of this patent is extended or adjusted under 35 U.S.C. 154(b) by 115 days.

(21) Appl. No.: 11/028,420

(22) Filed: Jan. 3, 2005

(65) Prior Publication Data

US 2005/0172466 A1 Aug. 11, 2005

Related U.S. Application Data

(60) Provisional application No. 60/577,570, filed on Jun. 7, 2004.

(30) Foreign Application Priority Data

Feb. 11, 2004 (FR) ..... 04 01363

(51) Int. Cl.
*B65H 69/06* (2006.01)
*B65H 57/16* (2006.01)

(52) U.S. Cl. ..... 28/209; 28/212

(58) Field of Classification Search ..... 28/209, 28/210, 211, 212, 198, 199, 201, 202, 208, 28/213, 184; 242/475.1, 475.2, 475.3, 615; 156/502, 516, 512, 433, 507; 57/22, 23, 57/202

See application file for complete search history.

(56) References Cited

U.S. PATENT DOCUMENTS 1,133,830 A * 3/1915 Wenzel ..... 28/209
1,383,130 A * 6/1921 Lea ..... 28/209
2,537,007 A * 1/1951 Abbott, Jr. ..... 28/209
2,585,708 A * 2/1952 Welch ..... 28/209
3,447,212 A * 6/1969 Altenweger ..... 28/211
3,616,054 A * 10/1971 Williams ..... 156/158
3,695,975 A * 10/1972 Williams ..... 156/502
3,793,117 A * 2/1974 Brooks ..... 156/433
5,003,676 A * 4/1991 McFalls ..... 28/209
5,032,214 A * 7/1991 Kile ..... 156/502
5,297,323 A * 3/1994 Jaeggi ..... 28/211
5,317,790 A * 6/1994 Plaschy ..... 28/209
6,073,434 A * 6/2000 Amos ..... 57/22

* cited by examiner

*Primary Examiner*—Amy B. Vanatta
(74) *Attorney, Agent, or Firm*—Stephen J. Stark; Miller & Martin PLLC

(57) ABSTRACT

Device for joining yarns between two machines for treating yarns. The present invention relates to a device for joining yarns between two machines for treating yarns, such as thermofixing and winding or beaming machines or steaming and winding or beaming machines or between means of feeding a multitude of yarns and weaving or tufting machines, characterized in that it is primarily made up of a supporting frame (1), a means (2) for individually guiding the yarns coming from the downstream machine and inserting these yarns in the means (3) for joining by entangling, by fusion or otherwise, a means (4) of individually bringing in and temporarily holding the yarns coming from the upper machine (4), a device (5) for inserting these yarns in the means (3) for joining by entangling, by fusion or otherwise, sets (6 to 8) for locking the yarns in position before and during the joining by entangling, by fusion or otherwise, and a means of cutting the free ends of the yarns before said joining.

The invention is more particularly applicable to the field of the textile industry, in particular machines for joining yarns layers between two machines for treating yarns.

21 Claims, 5 Drawing Sheets

MACHINE FOR JOINING YARNS

CLAIM OF PRIORITY

This application claims the benefit of U.S. Provisional Patent Application 60/577,570 filed Jun. 7, 2004, and French Patent Application No. 04.01363, filed Jan. 11, 2004.

FIELD OF THE INVENTION

The present invention relates to the textile industry, in particular to machines for joining yarn layers between two machines for treating yarns, such as thermofixing and winding or beaming machines or steaming and winding or beaming machines or between means of feeding a multitude of yarns and weaving or tufting machines, and presents a device for joining yarns between such machines used to treat yarns.

Description of Related Art

We currently know of various devices for joining one yarn to another, in particular for connecting the end of yarn at the end of a bobbin to the end of yarn at the start of a new bobbin. It is therefore possible to insert long lengths of yarn in various textile machines, with these lengths only being limited by the number of bobbins implemented.

These yarn joining machines, generally known as splicers operate according to two principles. These principles consist either of thoroughly mingling by means of a whirling air jet which performs an entangling of the end fibres of two yarn ends to be joined, or when the material making up the yarn allows it, i.e. in the case of thermoplastic yarns, by fusion of the two ends to another.

Publications U.S. Pat. Nos. 6,073,434 and 5,003,676 respectively describe devices which enable the simultaneous joining of a plurality of pairs of yarns and perform the joining of each pair of yarns according to one of the principles mentioned above. However, U.S. Pat. No. 6,073,434 describes a device in which each yarn, coming from both the upper machine and the lower machine, is individually inserted in the means for joining by entangling. The insertion of the yarns requires a long and tedious process.

Furthermore, publication U.S. Pat. No. 5,297,323 describes a device which moves a joining unit in front of each pair of yarns to be joined and therefore performs a joining of pairs of yarns one after the other.

Using known multi-yarn joining apparatus and devices such as described above makes it possible to save a substantial amount of time compared with a manual joining process for each of the pairs of yarns to be joined.

However, these known devices and apparatus require a considerable amount of time to prepare them to present each individual yarn, constituting a pair of yarns to be joined, in a correct position in relation to a joining device.

SUMMARY OF THE INVENTION

The object of the present invention is to overcome the drawbacks of the known devices and apparatus by proposing a yarn joining device, in particular between two yarn treatment machines, such a thermofixing and winding or beaming machines, or steaming and winding or beaming machines or between means of feeding a multitude of yarns and weaving or tufting machines, allowing quick and accurate positioning of the yarn ends of a pair of yarns to be joined to one another.

For this purpose, said yarn joining device is characterized in that it is primarily made up of a supporting frame, a means for individually guiding the yarns coming from the lower machine and simultaneously inserting all these yarns in the means for joining by entangling, by fusion or otherwise, a means for individually bringing in and temporarily holding the yarns coming from the upper machine, a device for inserting all these yarns coming from the upper treatment machine in the means for joining by entangling, by fusion or otherwise, sets for locking the yarns in position before and during the joining by entangling, by fusion or otherwise, and a means of cutting the ends of the free yarns before said joining.

BRIEF DESCRIPTION OF DRAWINGS

The invention shall be more fully disclosed in the following description, which refers to a preferred form of embodiment, given by way of a non-restrictive example and explained with reference to the accompanying schematic drawings, in which.

DETAILED DESCRIPTION OF THE PREFERRED EMBODIMENTS

Figure 1:
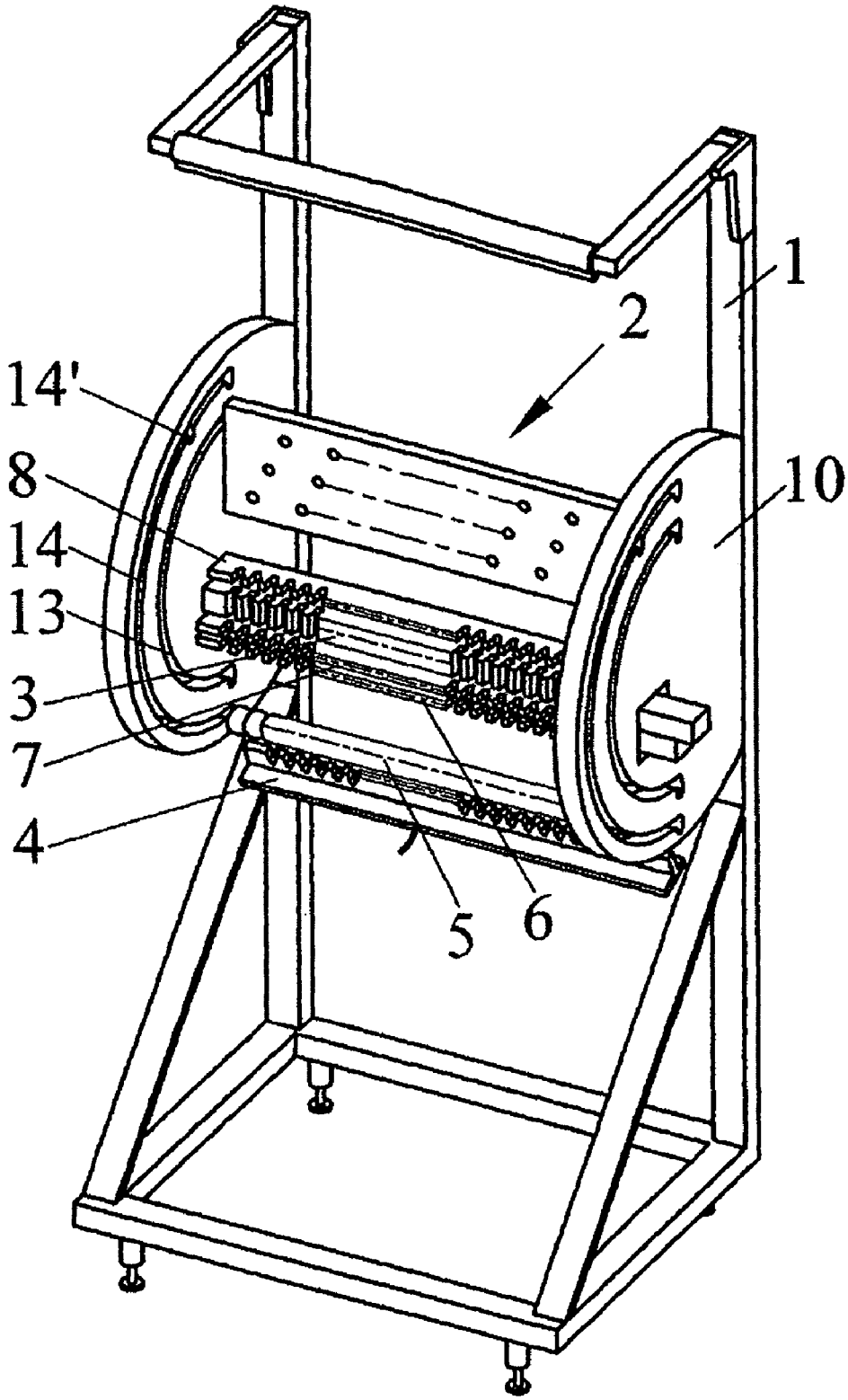
FIG. 1 is a perspective of a device in accordance with the invention arranged between two machines for treating yarns.

FIG. 1 in the accompanying drawings shows, by way of example, a device designed to be mounted between the machines for treating yarns, such as thermofixing and winding or beaming machines or steaming and winding or beaming or between means for feeding a multitude of yarns and weaving or tufting machines, with a view to joining the yarns.

In accordance with the invention, this device is primarily made up of a supporting frame 1, by a means 2 of individually guiding the yarns coming from the lower machine and simultaneously inserting all these yarns in means 3 for joining by entangling, by fusion or otherwise, by means 4 of bringing in and individually holding the yarns coming from the upper machine temporarily, by a device 5 for simultaneously inserting all these yarns coming from the upper treatment machine in the means 3 for joining by entangling, by fusion or otherwise, by sets 6 to 8 which lock the yarns in position before and during the joining by entangling, by fusion or otherwise, and by means 9 of cutting the ends of the free yarns before said joining.

The supporting frame 1 can come in the shape of a moving independent frame, as shown in FIG. 1 of the accompanying drawings, or be connected to one of the lower or upper machines treating yarns and presents, on the one hand, primarily two parallel lateral flanges 10, between which are mounted the means 2 for individually guiding the yarns coming from the lower machine and simultaneously inserting all these yarns in the means 3 for joining by entangling, by fusion or otherwise, means 3 for joining by entangling, by fusion or otherwise, the device 5 for simultaneously inserting all of the yarns, coming from the lower machine, in the means 3 for joining by entangling, by fusion or otherwise, the sets 6 to 8 for locking the yarns in position before and during the joining by entangling, by fusion or otherwise, and the means 9 for cutting the free ends of the yarns before joining, and on the other hand, a means of receiving and holding the means 4 of bringing in and individually holding the yarns entering the lower machine temporarily.

The means 2 for individually guiding the yarns coming from the lower machine and simultaneously inserting all these yarns in means 3 for joining by entangling, by fusion or otherwise, is made up of an eye plate 11 for guiding the yarns coming from the lower machine, fixed between the parallel lateral flanges 10 of the supporting frame 1, and also a mobile backplate 12 which can be moved parallel to the eye plate 11, by means of axes (not shown) provided close to its upper edge and co-operating with guides 13 provided in the parallel lateral flanges 10. The guides 13 extend in front of the eye plate 11 and describe, between their ends close to the latter, a non rectilinear path, moving away from said eye plate 11, their said ends being provided with index and location notches. In the form of embodiment shown in FIGS. 1 to 4 of the accompanying drawings, the guides present a semi-cylindrical shape, however, they could also have another curvilinear shape, or even a broken line shape.

Furthermore, to set it moving in the guides 13, the mobile backplate 12 is advantageously provided, close to its upper edge, with at least one operating lever, not shown. Using such a lever, the mobile backplate 12 can easily be brought from its idle position, with the lower and upper treating machines operating normally, to its position for putting in place the yarns coming from the lower machine and inserting these yarns in the means 3 for joining.

The means 3 for joining by entangling, by fusion or otherwise, is of a type known under the name of "splicer" and comes in the shape of a longitudinal bar extending between the parallel lateral flanges 10 and provided at regular intervals with notches 3' for receiving the ends of the yarns to be joined, a pneumatic nozzle or a heating device opening inside each notch 3' to perform the pneumatic entangling or the fusion welding. Furthermore, the longitudinal bar forming the means 3 can be provided on its upper face with a bar for partially closing the upper part of the notches 3'. Such a closing bar is known in the art and is mounted movably transversely on the bar forming the means 3, so as to allow the yarns to be pinched before and during the pneumatic entangling operation or during the fusion welding.

According to one characteristic of the invention, the means 3 for joining by entangling, by fusion or otherwise, is mounted between the parallel lateral flanges 10 with the possibility of slight movements parallel to the ends to be joined by entangling or by welding, for example by means of a pneumatic, electric or mechanical jack during the joining operation. The movement of the means 3 can be controlled by means of a programmable logic controller or by another automatic control device, taking into account the start of the entangling or welding operation and the total duration of this operation.

Figure 3:
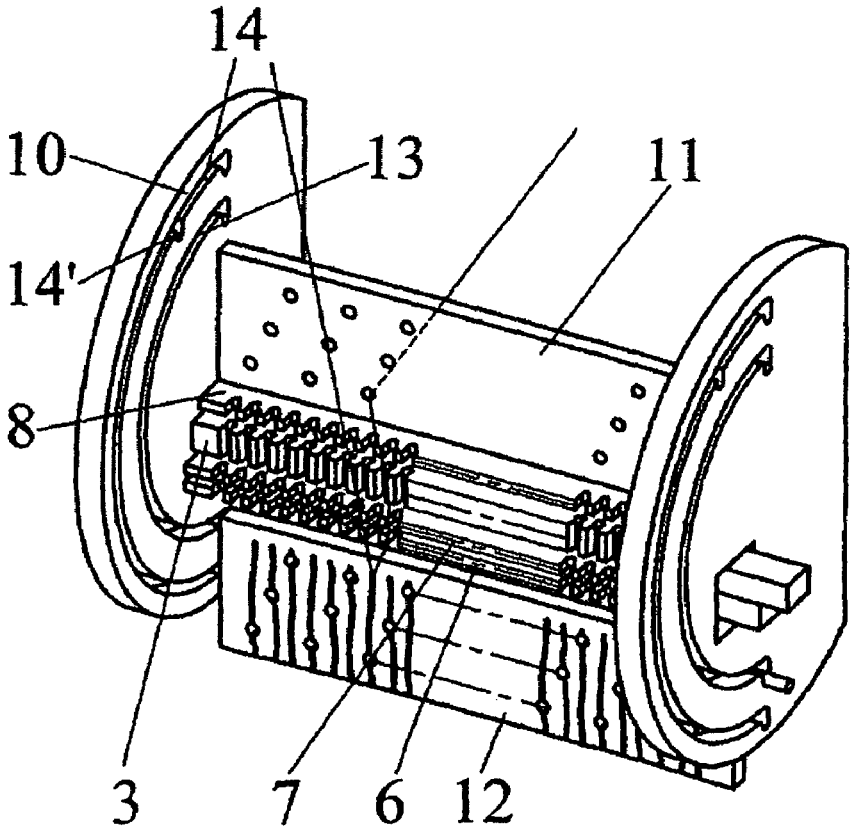
FIG. 3 is a similar view to the one in FIG. 2, showing the device in the position for inserting yarns from the lower machine in a knotting means.

The mobile backplate 12 is applied against the eye plate 11 during the yarn treatment machines' normal operating periods and can be moved, in a position for simultaneously inserting all the yarns coming from the lower machine in the means 3 for joining by entangling, by fusion or otherwise, by performing a movement according to a removal trajectory, which first of all separates the yarns from the eye plate 11, and then brings the latter back simultaneously, each into a notch 3' of the means for joining 3 (FIG. 3).

The means 4 for bringing in and temporarily holding the individual yarns coming from the upper machine preferably comes in the form of a comb for pinching each yarn individually, this comb being arranged in a position to insert all these yarns simultaneously into the notches 3' corresponding to the means for joining 3, in the means for receiving and holding the supporting frame 1, coming in the form of housings for the ends of said comb.

The device 5 for simultaneously inserting the yarns coming from the upper machine into the means 3 of joining by entangling, by fusion or otherwise, is advantageously made up of a guide rod presenting an equal number of parallel circumferential grooves as there are notches on the comb forming the means 4, as well as notches on the means for joining 3, the spacing of whose grooves is equal to that of said notches 3' and is mounted on the supporting frame 1 in a movable manner in guide grooves 14 of the parallel lateral flanges 10. These guide grooves 14 extend preferably significantly parallel to the guide grooves 13 of the mobile backplate 12 of the means 2 and outside these grooves 13 in relation to the centre of the flanges 10, these guide grooves 14 being fitted at each end with an index and location notch, as well as an intermediate index and location notch 14', close to its upper end and at a distance from the means 2.

Figure 2:
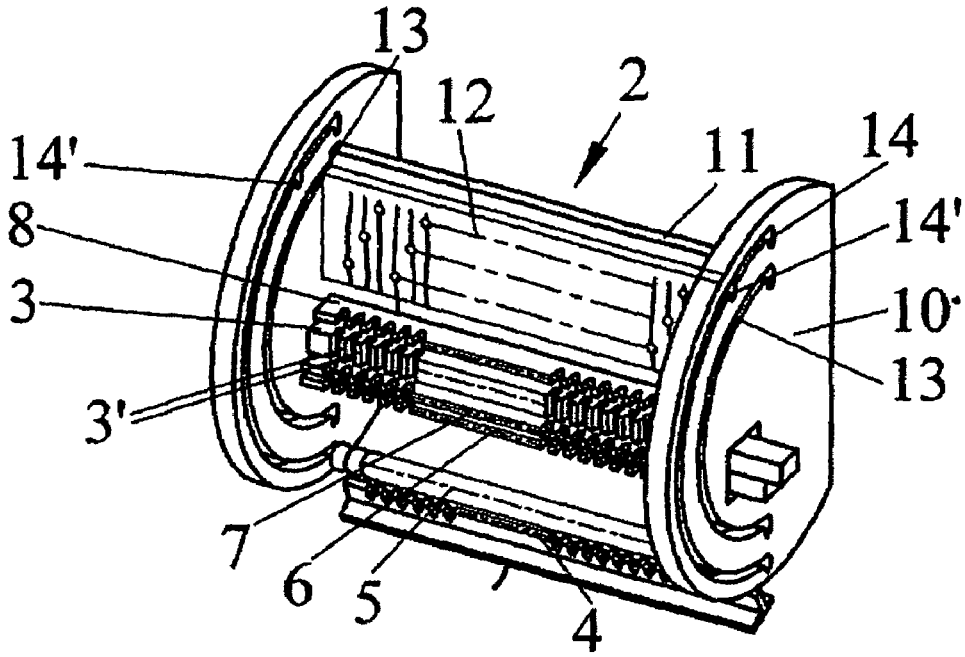
FIG. 2 is a partial perspective, on a larger scale, showing the device without the supporting frame.

So, the guide rod forming the device 5 can be moved from a lower idle position, such as shown in FIGS. 1 and 2 into an intermediate position (FIG. 4) in which the comb forming the means 4 can be passed over said guide rod and in front of the means 2, with a view to being placed on the supporting frame 1 (FIG. 5) in its holding position shown in FIG. 1. Each individual yarn, held by the comb forming the means 4, is then guided in a peripheral groove of the rod forming the device 5 and, after mounting said comb in its holding position in the supporting frame 1, each yarn will find itself opposite a notch 3' of the means 3 for joining by entangling, by fusion or otherwise for simultaneous joining of the yarns.

The means 9 for cutting the free ends of the yarns before the joining operation consists of a sharp blade mounted on a moving carriage which is guided transversely under the means for joining 3, in the immediate vicinity of the latter.

The units 6 to 8 for locking the yarns in position before and during the joining by entangling, by fusion or otherwise, primarily consist of three cross slides for pinching the yarns individually, these cross slides being, on the one hand, arranged respectively, the first one 6, under the rod forming the means 3 and at a distance from the latter, the second one 7 between the first one 6, and the means for cutting 9 mounted movably under the rod forming the means 3 and the third one 8 above the rod forming the means 3, and on the other hand, each being provided with its own means of activating the pinching. The first cross slide 6 and the second cross slide 7 are movable perpendicular to their longitudinal extension by guiding in the parallel lateral flanges 10 and are allocated, respectively, the first one 6 to pinching the yarns from the layer of yarns coming from the lower treatment machine and the second one 7 to simultaneously pinching the yarns from the layer of yarns coming from the upper treatment machine, after they have been put in place, and the yarns already in place from the layer of yarns coming from the lower machine, the third cross slide 8 performing the simultaneous pinching of said yarns in pairs, during the operations to cut their end and join by entangling, by fusion or otherwise. Cross slides of this type present notches for inserting yarns each fitted with a mobile pinching element, with all a cross slide's moving pinching elements being connected to an actuator, such as a jack.

The cross slide 6 is furthermore, advantageously fitted in its lower part with a transversal cutting means with a blade or heating filament (not shown), for cutting yarns coming from the lower machine after they have been put in position.

The device for joining yarns described above operates as follows:

After stopping a lower and/or upper treatment machine, possibly following a yarn breakage or another operating problem, all the yarns coming from the lower treatment machine which are still threaded or possibly threaded again in the means 2 for individually guiding the yarns, have to be joined to the corresponding yarns coming from the upper treatment machine.

In order to do so, the ends of the yarns threaded in the means 2 are displaced simultaneously, by means of the mobile backplate 12 of the means 2 for individually guiding the yarns, from the latter's initial position shown in FIGS. 1 and 2 of the accompanying drawings into the position shown in FIG. 3 of the accompanying drawings. The displacement is performed by slightly lifting up the mobile backplate 12 out of the index and location notches provided at the upper end of the guides 13 equipping the parallel lateral flanges 10 of the supporting frame 1, using one or more levers advantageously provided close to the upper edge of said mobile backplate 12.

During the displacement of the mobile backplate 12, the yarns threaded into the eye plate 11 and into the mobile backplate 12 are pulled simultaneously through the eye plate 11 and brought vertically into the notches 3' of the means 3 for joining by entangling, by fusion or otherwise, and, in the extreme lower position of the mobile backplate 12, the part of the yarns coming out of said notches 3' of said means for joining 3 is simultaneously brought into the first cross slide 6 forming one of the units for locking the yarns and is tightened in this cross slide by pinching it. During this operation, the second cross slide 7 for locking the yarns is assigned a reversing movement in relation to the plane passing by the front faces of the means for joining 3 and the first cross slide 6. After this pinching operation, the end of the yarns overlapping on the lower part of the cross slide 6 is cut using the cutting device equipping the latter.

The mobile backplate 12 is then put back in its starting position, in which it is held against the eye plate 11. The guide rod forming the device 5 is then moved from its lower idle position, i.e. under the cross slides 6 and 7 and under the means for joining 3, by being guided in the grooves 14 of the parallel lateral flanges 10, towards an intermediate position, in which it is held in the index and location notches 14' of said grooves 14. The comb for pinching each yarn individually forming the means 4 for bringing in and temporarily holding the individual yarns from the upper machine, on which said yarns have been threaded beforehand, is then put in place, successively by passing above the guide rod forming the device 5, in such a way that each yarn is simultaneously guided in a circumferential groove of said rod, in front of the means 2 for individually guiding the yarns coming from the lower machine and in front of the means for joining 3, as well as in front of the second cross slide 7 for locking the yarns in position, and then by mounting its ends in the corresponding housings of the supporting frame 1.

Figure 4:
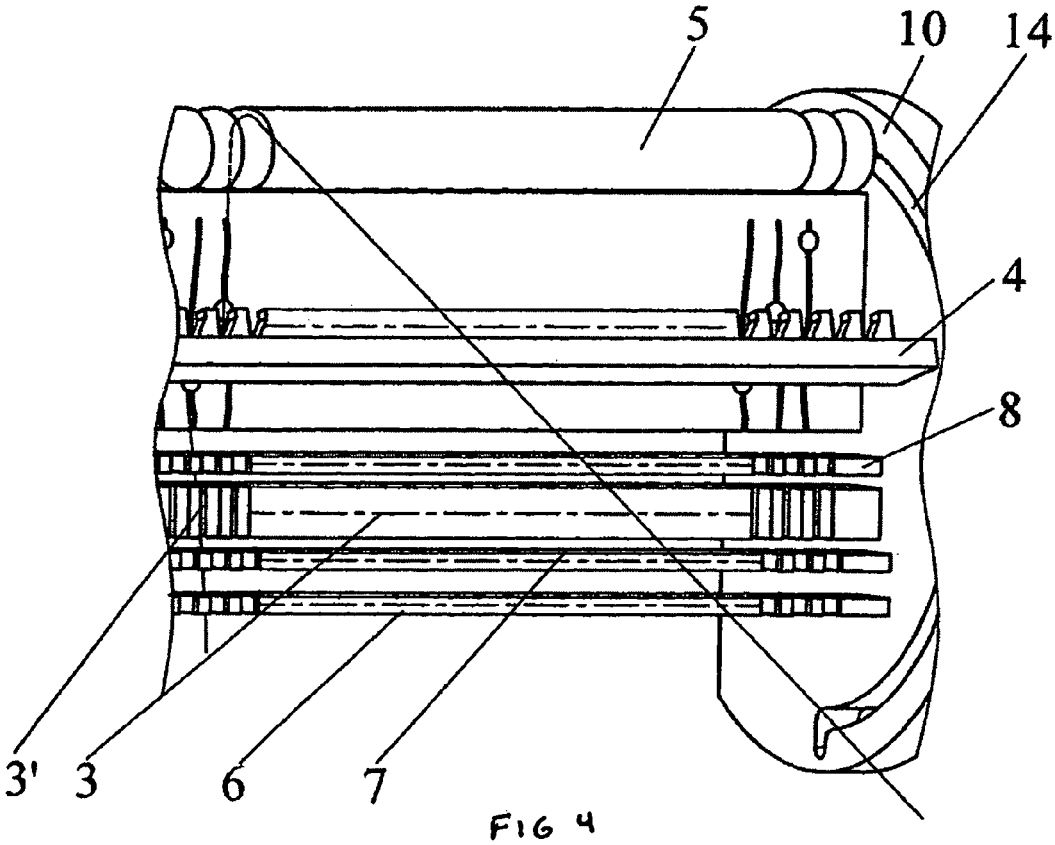
FIG. 4 is a partial view, on a larger scale, showing the start of the phase where the yarns from the lower machine are inserted in a knotting means.

This results in all the yarns held by the comb forming the means 4 being brought simultaneously in front of the notches 3' of the means for joining 3 as well as in front of the notches for inserting the yarns from the second cross slide 7 the first cross slide 6 already pinching the yarns coming from the lower treatment machine then being brought into a retracted position in relation to the front face of the second cross slide 7. The guide rod forming the device 5 is then displaced in its extreme upper position by removing it from the intermediate index and location notches 14' and guiding it in the grooves 14 as far as the upper end of the latter and inserting its axis in the corresponding end index and location notches (FIG. 4).

Figure 5:
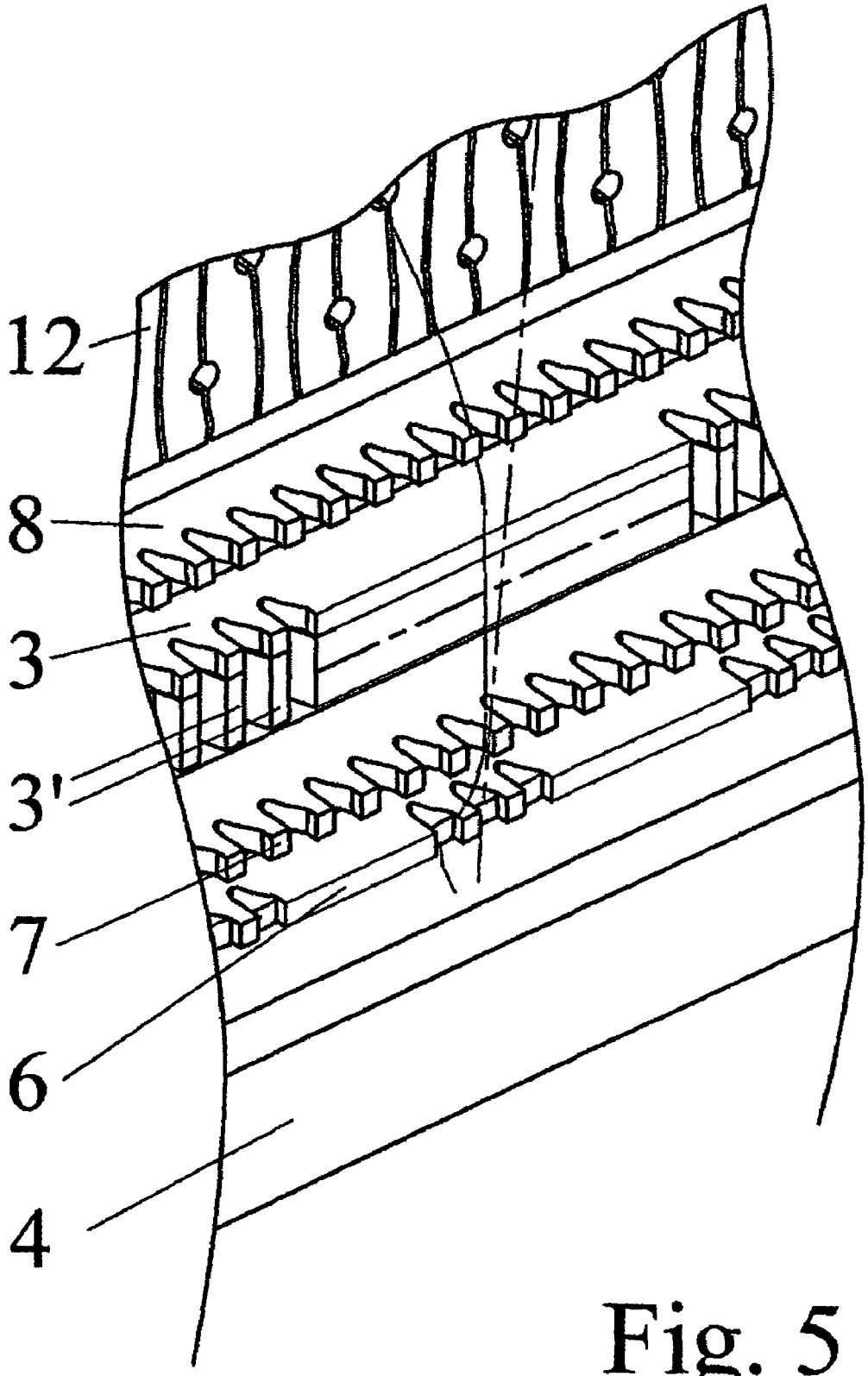
FIGS. 5 and 6 are perspectives, on an even larger scale, showing respectively the final insertion of the yarns coming from the upper machine, in the knotting means and the cutting of the free ends of the yarns before they are joined.
Figure 6:
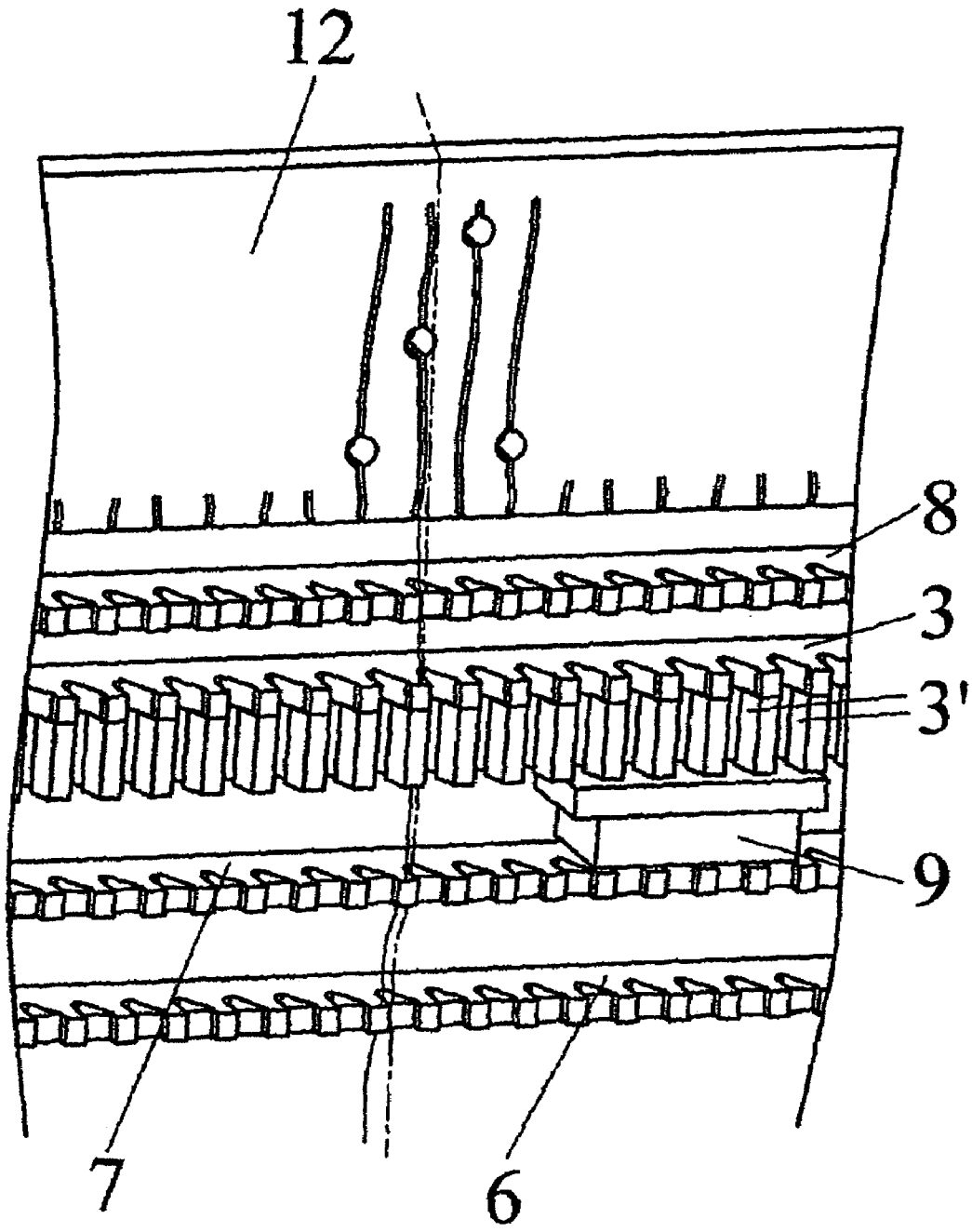

By arriving in this position, the device 5 simultaneously displaces the yarns, guided on the guide rod comprising it, into such a position that they penetrate, on the one hand, the notches for inserting the yarns of the second cross slide 7 and, on the other hand, the notches 3' of the means for joining 3 (FIG. 5). The pincers of the second cross slide 7 are then activated on closure, so that the yarns coming from the upper treatment machine, as well as the yarns coming from the lower treatment machine are simultaneously pinched in this second cross slide 7. Indeed, due to the prior withdrawal of the first cross slide 6 pinching the yarns coming from the lower treatment machine, these yarns have automatically penetrated the corresponding notches of the second cross slide when it arrives in the operating position, after the yarns from below are pinched by the first cross slide 6.

Simultaneously, the bar for closing the means for joining 3 is also activated in the sense that the yarns are pinched, as is the third cross slide 8, so that the ends of the yarns are completely immobilized, in particular at the longitudinal bar forming the means for joining 3. The cutting means 9 is then activated and its sharp blade, mounted on a mobile carriage, performs a quick transverse displacement during which all the yarns are cut very close to the lower face of the bar forming the means for joining 3. The nozzles or the heating devices equipping the latter's notches 3' are then supplied with pressurized air or electrically, so as to perform an entangling or a fusion of the fibers of the cut ends of each pair of yarns housed in each notches 3'. In order to perfect this entangling or this fusion, the means for joining 3 can be assigned a slight up and down movement.

Due to the invention, it is possible to make a device for joining yarn between yarn treatment machines, such as thermofixing and winding or beaming machines or steaming and winding or beaming machines or between means of feeding a multitude of yarns and weaving or tufting machines, while making it possible to carry out very quickly and very precisely the preparatory work to position the ends of yarn of a pair of yarns to be joined together.

Of course, the invention is not limited to the form of embodiment disclosed and shown in the accompanying drawings. Modifications remain possible, notably from the point of view of the structure of the various elements or by substituting equivalent techniques, without for all that deviating from field of protection of the invention.

What is claimed is:

1. A device for joining yarns intermediate a first and a second machine, said device comprised of:

a supporting frame having a means for individually guiding yarns coming from the first machine and simultaneously inserting all these yarns in the means;

a means for joining yarns, said means for individually guiding yarns coming from the first machine inserting the yarns in the means for joining yarns, said means for joining yarns connecting yarn pairs together upon activation;

a means for individually bringing in and at least temporarily holding yarns coming from a second machine;

a device for simultaneous insertion of all these yarns coming from the second treatment machine in the means for individually bringing in and at least temporarily holding yarns in the means for joining yarns;

at least one set locking the yarns in position before and during the activation of the means for joining yarns; and a means for cutting the free ends of the yarn pairs.

2. The device of claim 1 wherein at least one of the first and second machines are selected from the group consisting of thermofixing, winding, beaming, weaving and tufting machines.

3. The device of claim 1 wherein the means for joining further comprises at least one of means for joining by fusion and means for joining by entangling.

4. The device of claim 1 wherein the supporting frame is connected to one of the first and second machines.

5. The device of claim 1 wherein the frame further comprises:

two parallel lateral flanges;

said means for individually guiding yarns from the first machine mounted intermediate the two parallel flanges;

said means for individually bringing in and at least temporarily holding yarns mounted intermediate the two parallel flanges;

said means for joining yarns mounted intermediate the two parallel flanges;

said device for inserting yarns mounted intermediate the two parallel flanges;

said at least one set mounted intermediate the two parallel flanges; and said means for cutting mounted intermediate the two parallel flanges.

6. The device of claim 5 wherein the frame further comprises guides; and the means for individually guiding the yarns from the first machine further comprises an eye plate fixed intermediate the parallel flanges of the frame; and a mobile backplate; said backplate moveable parallel to the eye plate as restrained by the guides.

7. The device of claim 6 wherein the frame has a front, and the guides extend in front of the eye plate, said guides defining a non-rectilinear path moving away from the eye plate; and said eye plate having ends having index and location notches.

8. The device of claim 6 wherein the mobile blackplate has an upper edge, and at least one operating lever proximate to its upper edge.

9. The device of claim 1 wherein the means for joining further comprises:

a longitudinal bar having notches at spaced regular intervals, said notches receiving the ends of the yarns to be joined, and one of a pneumatic nozzle and a heating device inside each of the notches.

10. The device of claim 9 wherein the longitudinal bar has an upper face, and further comprising a bar configured to at least temporarily close an upper part of the noches at the upper face of the longitudinal bar.

11. The device of claim 9 wherein the frame further comprises parallel lateral flanges, and the means for joining is moveable parallel to the lateral flanges during the activation of the means for joining.

12. The device of claim 6 wherein the mobile backplate is applied against the eye plate during normal operation of the first and second machine; said mobile backplate is moved into a position for inserting the yarns from the first machine in the means for joining through a removal trajectory, wherein movement through the removal trajectory separates the yarns from the eye plate, and then brings each of the yarns into the notches of the longitudinal bar.

13. The device of claim 9 wherein the bringing in and at least temporarily holding yarns coming from a second machine means further comprises a comb, said comb having notches which pinch each of the yarns individually, said comb configured to insert the yarns in corresponding notches of the joining means.

14. The device of claim 13 wherein the device for inserting the yarns in the means for joining further comprises a guide rod having an equal number of circumferential grooves as there are notches on the comb as well as notches on the means for joining, said spacing of the grooves on the guide rod and the notches on the comb and the means for joining being equal.

15. The device of claim 14 wherein the frame further comprises parallel flanges having guide grooves, and the guide rod is mounted to the flanges and is moveable in the guide grooves.

16. The device of claim 15 wherein the frame further comprises guides; and the means for individually guiding the yarns from the first machine further comprises an eye plate fixed intermediate the parallel flanges of the frame; and a mobile backplate; said backplate moveable parallel to the eye plate as restrained by the guides;

said guide grooves extending substantially parallel to the guides and outside of the guides in relation to a center of the parallel flanges;

said guide grooves having a first end and a second end, both first and second ends having an index and location notch, said guide grooves further comprising an intermediate index and location notch proximate to the first end at a distance from the means for individually guiding yarns from the first machine.

17. The device of claim 1 wherein the means for cutting the free ends of the yarn pairs further comprises a sharp blade mounted on a moving carriage, said carriage moved transversely below and proximate to the means for joining.

18. The device of claim 1 wherein the at least one set further comprises three cross slides, said cross slides selectively pinching the yarns individually, said three cross slides comprised of a first cross slide located a distance under a rod forming the joining means, a second cross slide located intermediate the first cross slide and the cutting means, said second cross slide moveably mounted under the rod, and a third cross slide located above the rod; each of said first, second and third slides at least individually activated to pinch to lock the yarns in position.

19. The device of claim 18 wherein the first and second cross slides are movable perpendicular to a longitudinal extension by guiding relative to of the frame, the first cross slide pinching the yarns from the yarns coming from the first machine, the second cross slide simultaneously pinching yarns from the second machine, and after pinching with the first and second cross slides, said third cross slide simultaneously pinching yarns as yarn pairs with said means for joining and said means for cutting then joining and cutting the respective yarn pairs together.

20. The device of claim 18 wherein the first cross slide further comprises a lower part having a transversal cutting means for cutting yarns after positioning immediately before the activation of the means for joining yarns.

21. A device for joining yarns intermediate a first and a second machine, said device comprised of:

a supporting frame having two parallel lateral flanges and guides;

an eye plate fixedly mounted intermediate the parallel flanges of the frame;

a mobile backplate disposed intermediate the parallel flanges; said backplate moveable parallel to the eye plate as restrained by the guides;

a joining device having a longitudinal bar with notches at spaced regular intervals, said notches receiving ends of yarns to be joined, and one of a pneumatic nozzle and a heating device inside each of the notches;

a comb, said comb having notches configured to pinch yarns individually, said comb configured to insert the yarns in corresponding notches of the joining device;

a guide rod having a corresponding number of circumferential grooves as there are notches on the comb as well as notches on the joining device, said spacing of the grooves on the guide rod and the notches on the comb and the joining device being at least substantially equal;

a cutter disposed below the joining device; and three cross slides, said cross slides selectively pinching the yarns individually, said three cross slides comprised of a first cross slide located a distance under the joining device, a second cross slide located intermediate the first cross slide and the cutter, said second cross slide moveably mounted under the cutter, and a third cross slide located above the rod; each of said first, second and third slides at least individually activated to pinch to lock yarns in position.

* * * * *